United States Patent [19]

Sims, Jr. et al.

[11] Patent Number: 4,928,083

[45] Date of Patent: May 22, 1990

[54] WIPER FOR VARIABLE ELECTRICAL RESISTOR

[75] Inventors: Dewey M. Sims, Jr., Wayne; Ray E. Mick, Troy, both of Mich.

[73] Assignee: Colt Industries Inc., New York, N.Y.

[21] Appl. No.: 335,797

[22] Filed: Apr. 10, 1989

[51] Int. Cl.[5] ..... H01C 1/12

[52] U.S. Cl. ..... 338/202; 338/162

[58] Field of Search ..... 338/202, 160, 162, 176, 338/170; 123/361, 350, 363, 399

[56] References Cited

U.S. PATENT DOCUMENTS 3,365,691 1/1968 Hillman ..... 338/202 X 3,569,897 3/1971 Laube et al. ..... 338/202 X 3,631,371 12/1971 Maurice ..... 338/162 X 4,050,051 9/1977 Kádár et al. ..... 338/202

*Primary Examiner*—Bruce A. Reynolds

*Assistant Examiner*—M. M. Lateef

*Attorney, Agent, or Firm*—Howard S. Reiter

[57] ABSTRACT

The wiper or movable contact of an electrical potentiometer employs fingers of an oval-like transverse cross section to increase the useful service life of the potentiometer in application such as a throttle position sensor where the potentiometer may be subjected to mechanical vibration, repeated random shock loading, constant movement, etc.

6 Claims, 3 Drawing Sheets

WIPER FOR VARIABLE ELECTRICAL RESISTOR

BACKGROUND OF THE INVENTION

I. Field of the Invention

The present invention is directed to potentiometer type devices, and more particularly to a wiper or movable contact of a variable electrical resistor which is subjected to adverse operating conditions.

II. Description of the Related Art

Variable electrical resistors or potentiometers are well known and have been employed in many applications, typically to tap off a portion of a supply voltage, as in a dimmer switch for household lighting. The variable resistor basically includes an elongate electrical resistor which is connected across the supply voltage and a wiper slidable along the resistor in electrical contact with the resistor and electrically connected via a device to be controlled to one end of the resistor. Typically, the resistor is laid out along a circular arc and the wiper is mounted for rotation about the center of that arc.

Because the voltage output of the variable resistor is representative of the position of the wiper, such resistors have found many applications in electrical control or indicating circuits in which the position of a movable member within its range of movement controls the position of the wiper so that an electrical signal representative of the position of the movable member is established.

One example of such an application is that of a throttle position sensor used in automotive vehicles to supply a signal representative of the throttle position to the on-board computer which employs this signal in conjunction with others to control operation of the vehicle engine, automatic transmission, etc. In this application, the rotatable wiper of the variable resistor is mechanicallv directly coupled to the shaft which carries the throttle or air-flow regulating plate.

While the above prior art throttle position sensor devices have performed generally satisfactorily, certain deficiencies and advantages have been noted, as follows:

Deficiencies (a) The "rake" type of contacts, both the round wire type and stamped metal type have jagged unpredictable contact areas.

(b) Secondary manufacturing operations to smooth these jagged contact areas cause damage to many fingers, such damaged fingers being costly and difficult to sort out, so that slightly damaged fingers may go into assemblies, thus reducing the quality of those assemblies.

(c) Small round wire fingers grouped closely adjacent to each other tend to get twisted together easily. When two fingers get twisted together, both of their loads are carried by only one contact area, such extra high contact load causing premature wear out.

(d) The round wires normally used have a small diameter, which by itself causes a high Hertz contact stress (see Chapter 18, Contact Stresses of "Engineering Considerations of Stress, Strain and Strength" by Robert C. Juvinall.)

(e) The stamped metal types of fingers are limited to a small number of fingers per group of contacts because of stamping tool limitations, the result of fewer contact fingers usually being undesirable because of the resulting higher contact noise.

(f) The small round wire fingers have a small cross-sectional section modular, which limits the length of the finger and the load at the end of the finger due to the concern of over-stressing the wire at the spot where it is secured.

(g) The stamped metal fingers, both the "rake" and "knuckle" design, have sharp edge on both sides of the width of the finger, which are not smoothed by secondary manufacturing operations and which edges produce high Hertz contact stresses when these fingers are slightly twisted or tilted relative to the substrate.

Advantages (a) The "knuckle" wire type of contact has a more reproducible contact area accomplished without a secondary manufacturing operating like tumbling.

(b) The large number of rounded cross-section fingers reduces the electrical contact noise.

(c) The rounded shape of the round wires allow each finger to smoothly slide past the adjacent finger without snagging.

(d) The wider stamped fingers help prevent the fingers from getting twisted together with the adjacent fingers.

(e) Rounded wires can be assembled easily and at a lower cost.

Thus, as is well-known to those skilled in the art, throttle position sensor device comprises a thin flat generally circular variable resistor track or path over which a wiper assembly travels, the wiper assembly being connected at one end to a rotor or shaft and comprising a plurality of wiper wire fingers of circular or rectangle cross-section and turned down at the free ends thereof in rake fashion, or upwardly in knuckle fashion.

Because all of these various parts are mounted on the engine block, the throttle position sensor is subjected to extremely harsh operating conditions insofar as wear between the wiper and resistor member is concerned. Studies have shown that during operation of the vehicle, the throttle position changes almost continuously, even when the driver believes he or she is holding the throttle in a steady position. In addition, the sensor is subjected to vibration from operation of the engine and shock loading from uneven road conditions.

While the wear so occasioned is of no great concern from the standpoint of mechanical operation of the sensor, it is of substantial concern from the electrical standpoint. The area of engagement between the wiper and resistor is very small, the resistive coating of the resistor is thin, and minor irregularities in the engaging surfaces, as may be created by uneven wear, pitting, etc., can have a substantial effect on the integrity of the electrical contact between the wiper and resistor with a consequent effect on the electrical signal derived from the sensor. Unfortunately, maximum wear on the resistor will inherently occur at those regions along the resistor which correspond to the most frequently used throttle settings. While the sensor itself is relatively inexpensive and easy to replace, it is an element whose operation is critical to efficient operation of the vehicle.

The present invention is directed to improvements in the wiper assembly which will minimize the problems referred to above, such as by minimizing wear, and thus prolonging the useful service life of the sensor.

SUMMARY OF THE INVENTION

In the throttle position sensor embodying the invention, which may include more than one wiper assemblies, each wiper assembly takes the form of a plurality of metal strips or fingers of circular or rectangular cross-section, each having one end fixedly mounted in or on a rotor rotatively locked to the throttle shaft, the individual strips projecting from the rotor to slidably engage the stationary electric resistor strip at their opposite free ends. The free resistor strip contacting end portions of the fingers are convexly bent longitudinally of the strip so that a smoothly curved, rounded "knuckle" slidably engages the resistor at its convex side. The fingers are conformed to be resiliently biased against the resistor. The transverse cross-sectional shape of the fingers is elongated in the transverse direction and is preferably of an oval configuration, the longer side of which comprises a transversely extending resistor engaging surface. This surface preferably would be flat, however, manufacturing problems to be described in greater detail below make a convexly curved resistor engaging preferable.

Other objects and features of the invention will become apparent by reference to the following specification and to the drawings.

DESCRIPTION OF THE INVENTION

Figure 2:
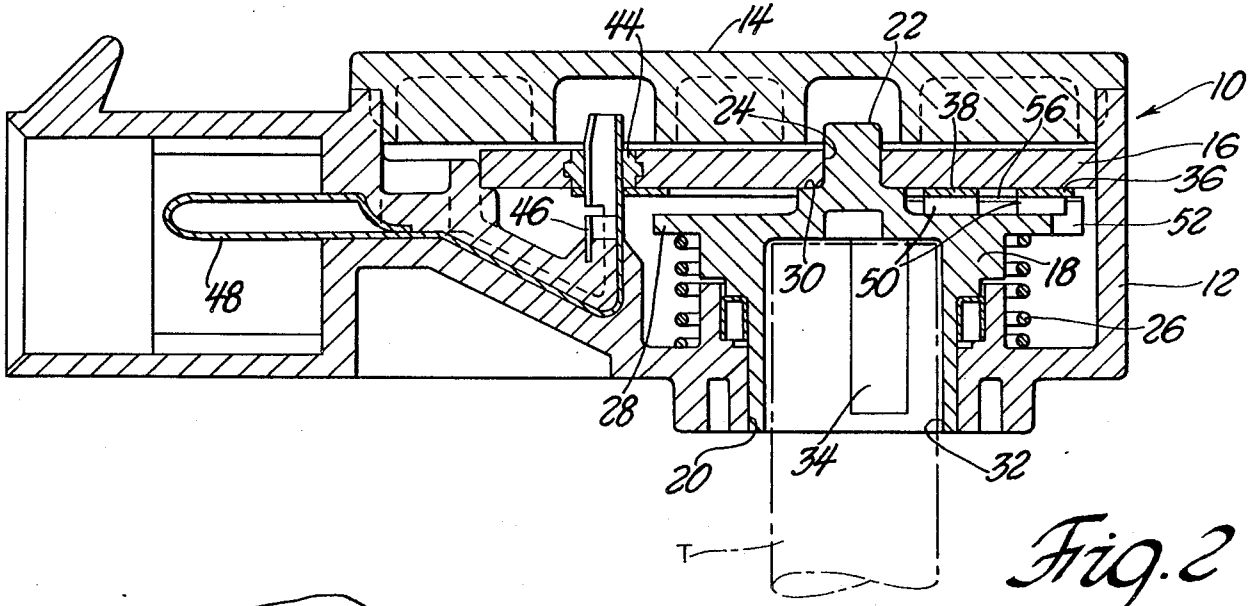
FIG. 2 is a cross-sectional view of the sensor of FIG. 1, taken on the plane of line 2—2 of FIG. 1, looking in the direction of the arrows.

Referring now particularly to FIG. 2, a throttle position sensor embodying the present invention includes a housing designated generally 10 made up of a main body portion 12 and a cover plate 14. A resistor carrier plate 16 is fixedly mounted within the main body portion of the housing and a rotor 18 is mounted within housing 10 for rotation relative to the housing and the resistor carrier plate. The main body portion 12, cover 14, resistor plate 16 and rotor 18 may be formed in any suitable way, such as being molded of any of several suitable electrically non-conductive thermoplastic or thermoset plastic materials.

Figure 1:
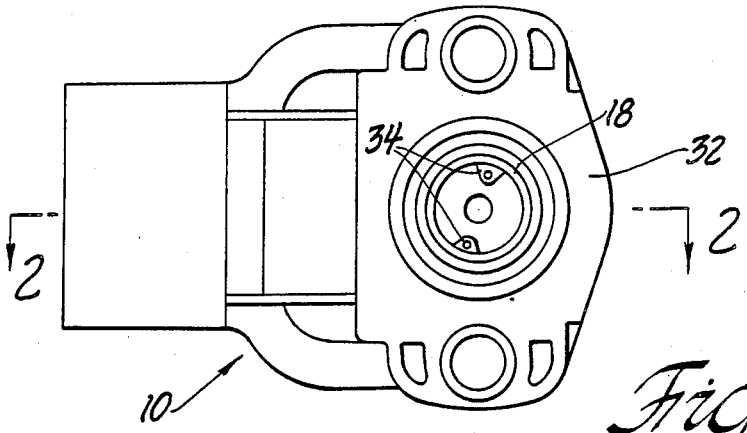
FIG. 1 is a side elevational view of a throttle position sensor embodying the present invention.

Rotor 18 is rotatably mounted within a bore 20 in main body portion 12 of the housing and is formed at its upper end, as viewed in FIG. 2, with a projecting stub portion rotatably received within a bore 24 in resistor carrier plate 16. A torsion spring 26 engaged between main housing 12 and a flange 28 resiliently biases the rotor against rotative displacement relative to the throttle shaft T and also acts in compression to bias the rotor upwardly as viewed in FIG. 2 toward the fixedly located carrier plate 16, movement of rotor 18 axially toward resistor plate 16 being limited by the engagement of a shoulder 30 on rotor 18 with the underside of the carrier plate. The lower end of rotor 18 is formed with a coaxially extending bore 32 having integrally formed radially inwardly extending projections at opposite sides (FIG. 1) to rotatively lock the rotor to the end of a throttle shaft indicated in broken line at T in FIG. 2.

Figure 4:
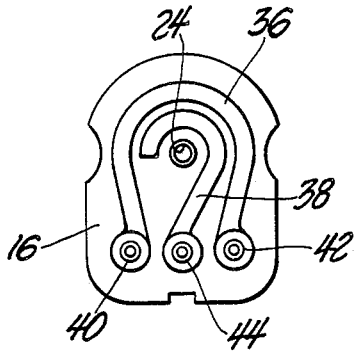
FIG. 4 is a front face view of an electrical resistor carrying plate of the sensor of FIG. 1.

Referring now to FIG. 4, one surface of carrier plate 16 has first 36 and second 38 strip-like, electric resistor elements bonded or otherwise fixed to the plate. Portions of each of elements 36, 38 extend along circular arcs centered on the axis of bore 24. The opposite ends of element 36 are electrically connected to electrically conductive connector elements 42 and 46, while one end of conductor 38 is connected to a third connector element 44. Referring to FIG. 2, element 44 is shown as being embedded in resistor plate 16 and receives a prong 46 at one end of a connector 48 by means of which an electrical connection to element 38 may be made from the exterior of the housing. A similar arrangement is employed to provide an external electrical connection to the ends of member 36.

Member 36 is coated with a material having electrical resistivity characteristics which are linear between the opposite ends of the member which will be hereafter referred to as a resistor. This coating typically is an ink applied by a silk screening process and approximately five one thousandths of an inch thick. Member 38 may have similar electrical characteristics or alternatively may be simply an electrical conductor of minimal resistance.

Figure 3:
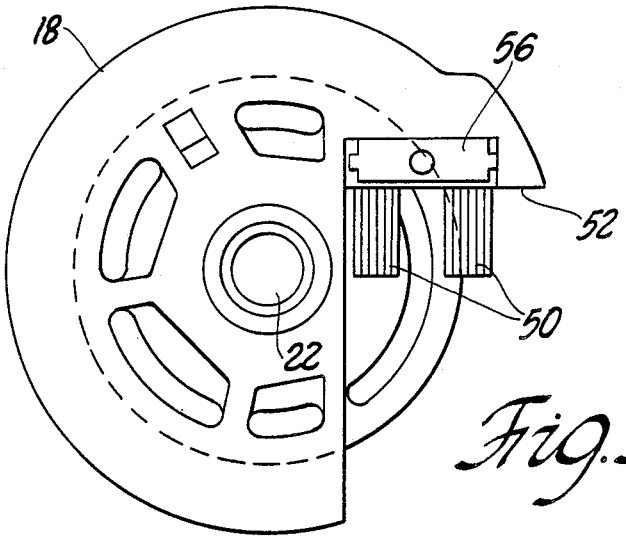
FIG. 3 is an end view of a wiper-carrying rotor of the sensor of FIG. 1.
Figure 5:
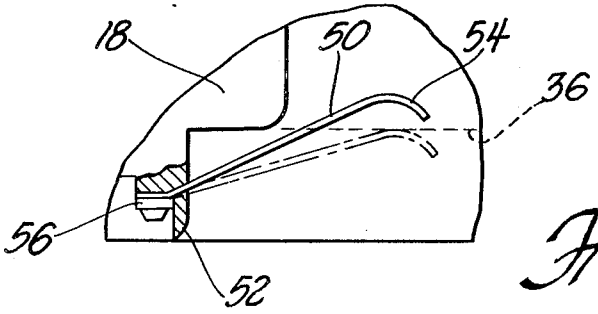
FIG. 5 is a side elevational view of a portion of the rotor of FIG. 3.

Referring now particularly to FIG. 3, it is seen that two groups of fingers 50 are fixedly mounted at one end upon rotor 18 to project from a shoulder 52 formed on the rotor. As best seen in FIG. 5, the fingers 50 are inclined upwardly relative to the rotor and formed with an upwardly convex curved portion or knuckle 54 adjacent the free end of the finger. The individual strips 50 are of an electrically conductive material and are initially formed in a configuration such that the fingers are resiliently deflected when engaged with elements 36, 38 as shown in FIG. 2 and indicated in broken line in FIG. 5.

The fixed ends of the individual fingers 50 are electrically connected to each other by a conductive plate 56 (FIGS. 2, 3 and 5), which is secured in any known manner, such as insert molding in, or thermally staking to, to rotor 18. The two groups of strips are so located (FIG. 3) that the radially outer or right-hand group of strips will slidably contact and traverse the arcuately curved portion of resistor 36 (FIG. 4), while the inner or left-hand group of strips 50 as viewed in FIG. 3 will similarly slidably contact the arcuately curved portion of conductor 38. As indicated in the broken-line showing of finger 50 in FIG. 5, contact between the finger and resistor 36 (or conductor 38) takes place at the convexly curved knuckle 54 of the fingers to provide for free sliding movement in either direction of rotation of the rotor.

The strips 50 of the present application are especially designed to extend the normal service life of the device to the maximum amount possible by minimizing wear of the electrically resistive coating of resistor 36 and element 38 occasioned by relative movement between this resistive surface and the engaged portions of wipers 50. While wearing of two opposed surfaces in rubbing or sliding contact with each other is most commonly attributed to frictional or abrasive action between the two surfaces, wear is also caused by spalling induced by the above-mentioned so-called Hertz contact stresses acting at and beneath the curved surfaces of bodies compressed against each other and moved in a reciprocating manner while at least one of the engaged surfaces is a curved surface in theoretical point or line contact with the other surface. Contact stresses may produce plastic deformation or flow and both surface and subsurface fatigue (spalling).

Figure 6:
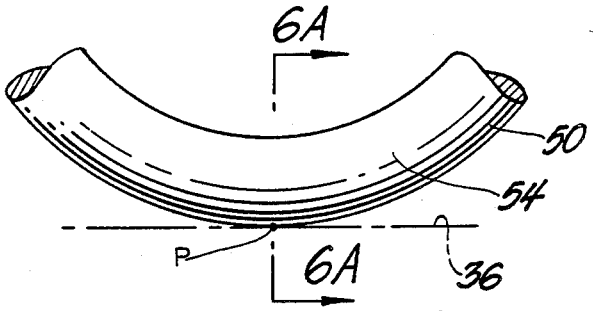
FIG. 6 is an enlarged side elevation of the engaging portions of the wiper and resistor with certain parts broken away or omitted.
Figure 6A:
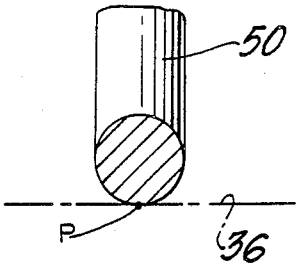
FIG. 6A is a cross-sectional view taken on line 6—6 of FIG. 6.

Referring now to FIG. 6, when viewed from the side, the convexly curved knuckle portion 54 of an individual strip 50 would theoretically contact the flat surface of resistor 36 at a single point P, assuming that strip 50 were to be of a circular transverse cross section as in FIG. 6A. Because strip 50 is resiliently biased against surface 36, even considering the fact that the engaged surface of strip 50 will deflect—i.e., flatten out against surface 36 to some extent, the engaged area over which the compressive forces are distributed is quite small, and the compressive stress is extremely high.

Figure 7:
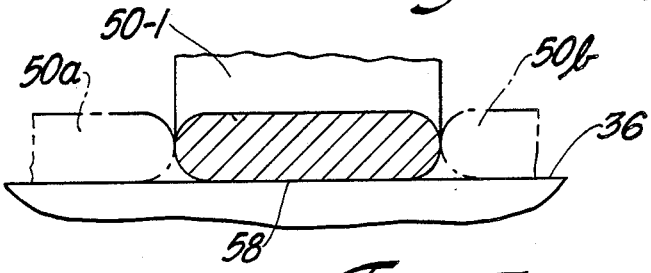
FIG. 7 is a cross-sectional view similar to FIG. 6A, but illustrating a first modification of the invention.

A substantial reduction of the compressive stresses may be achieved by modifying the transverse cross section of the strips from the circular cross section of FIG. 6A to the flattened oval cross section shown in FIG. 7. The strip 50-1 of FIG. 7 might be conveniently formed by flattening a round wire between opposed flat surfaced rollers. This arrangement transforms the theoretical point contact of FIGS. 6, 6A into a theoretical line contact which, considering the deflection or flattening of the engaged surface 58, presents a substantial increase in contact area with a consequent reduction of the compressive stress.

Figure 8:
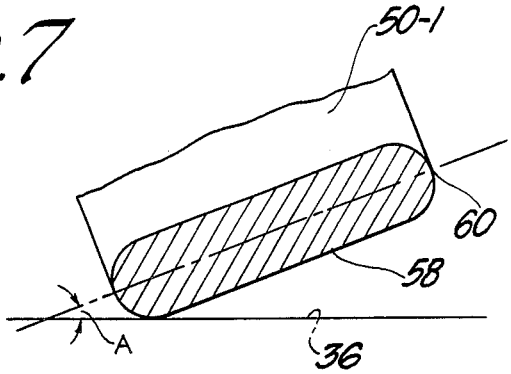
FIG. 8 is a cross-sectional view showing the strip of FIG. 7 in a tilted position.
Figure 9:
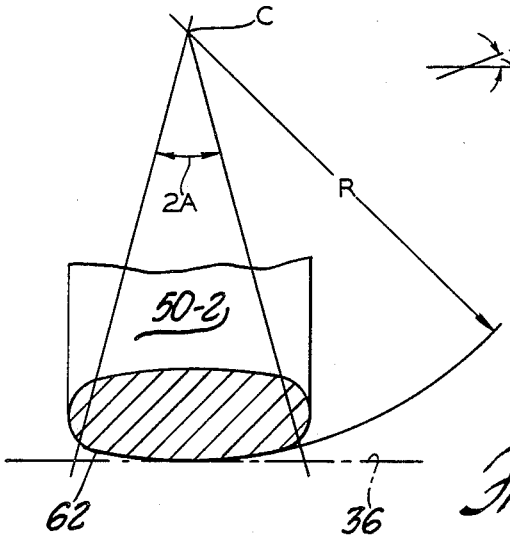
FIG. 9 is a cross-sectional view similar to FIG. 6A, but illustrating a second preferred embodiment of the invention.

However, the line contact between the transversely flat surface 58 is extremely difficult to achieve and maintain in practice. The dimensions of a commercial version of the throttle position sensor employs strips which are approximately 0.3 mm in width and 0.07 mm in thickness. The strips, when assembled into the throttle position sensor, are disposed in closely adjacent side-by-side relationship, as indicated in broken line at 50*a* and 50*b* in FIG. 7, and experience, as shown, that after assembly the probability is extremely high that the individual strips 50-1 will be tilted or twisted about their longitudinal axis at an angle a of between 0 and about 5 degrees as indicated in FIG. 8. Strips which are so tilted provide only the theoretical point contact of the circular cross section strips of FIGS. 6 and 6A and, in fact, produce a somewhat increased contact stress due to the fact that the radius of curvature of the curved side surfaces 60 of the strip of FIG. 7 is about the same size as the radius of the circular wire 50 of FIGS. 6 and 6A. However, on the whole, strips of the flattened oval cross section of FIGS. 7 and 8 provide an improved wiper assembly as compared to a wiper assembly whose strips are of circular cross section because the amount of tilt (greatly exaggerated in FIG. 8) for individual strips is a random amount and normally at least some of the strips will have a flat or substantially flat contact with the resistor as illustrated in FIG. 7.

Where the dimensions of the strips are relatively small, a preferred form of transverse cross sectional configuration for the strips is that of the strip 50-2 of FIG. 9 which closely approximates an elliptical configuration. This configuration may be readily formed by extruding the strip. In the transverse cross sectional configuration of FIG. 9, the surface 62 of the strip which is opposed to resistor 36 and/or 38 is formed with a radius of curvature R centered at a point C so located that radii from the opposite ends of surface 62 will include an angle 2*a*, where a is the estimated approximate maximum tilt (see FIG. 8) of the strip relative to the flat surface 36 or 38 of the resistor. This arrangement assures that the transverse curvature of the strip 50-2 at its theoretical point of contact with surface 36 or 38 will be a relatively large radius presenting a relatively increased effective contact area and a consequent reduced contact stress.

Prior art production wipers having rectangular cross section are stamped from sheet metal, formed with rake ends and assembled onto or into a plastic shaft. Such a stamped rake wiper design yields satisfactory vehicle life, but on an endurance engine dynamometer running at a constant throttle setting, may fail after 12 to 30 hours of continuous running. Testing under the same condition, but using fingers 50-1 embodying the invention, as shown in FIG. 7, the sensor was still operating after nearly 700 hours. Finger strips of 50-2 cross section, as shown in FIG. 9, are expected to yield additional benefits as explained later.

These tests involved strips of approximately 0.3 mm width. These particular tests impose an extremely severe test for wear failure of the throttle position sensor in that the throttle position is maintained at a constant setting throughout the test and, thus, the wiper fingers contact the resistor at a single constant location throughout the entire test.

In theory, an increase in the radius R of the surface 62 should result in a consequent reduction of the contact stress and, hence, an increase in the service life of the sensor. The width of the strips tested was limited because of the desirability of having a reasonably large number of independent strips (typically 6 per group) to assure that a reasonable number of strips are always in contact in the face of engine induced vibration. This last requirement imposes a design limitation on the transverse width of the individual strips where the overall size of the sensor must be limited because of economic considerations and availability of space or clearance for installation. The tilting problem illustrated in FIG. 8 arises because of the practical difficulties in achieving and maintaining the desired alignment and orientation of the various surfaces of the strip during the formation of the strip and the subsequent assembly of a group of strips onto the rotor, where the transverse dimension of the individual strips is but a fraction of a millimeter. On larger scale devices, this problem is not as acute in that the establishing and maintaining of the desired alignment and orientation of the various surfaces of the strip can be more easily achieved and verified. The elliptical strip of FIG. 9 is thus a preferred form where it is not practical to eliminate the possibility of tilting of the individual strips, while the flattened oval configuration of FIG. 8 may be preferred where the strips can be assembled in a non-tilted orientation.

While the invention has been described as applied in a throttle position sensor, it is believed apparent the invention is useful in other applications where an electrical potentiometer will be subjected to mechanical vibration wear problems, rapidly repeated shock loading, constant movement of wiper over the resistor in use of the sensor, etc.

Therefore, while exemplary embodiments of the invention have been described in detail, it will be apparent to those skilled in the art the disclosed embodiments may be modified. Therefore, the foregoing description should be considered exemplary rather than limiting, and the true scope of the invention is that defined in the following claims.

What is claimed is:

1. For use in an operating system wherein a movable control member is adjustably movable over a selected range of controlled movement and is also subjected to uncontrolled movement such as might be induced by extraneous vibration, shock loading or the like; a variable electrical resistor adapted to be connected in an electrical circuit to electrically signal the position of said control member within its selected range of movement, said resistor including a fixedly located, flat, elongate electrical resistor member, electrically conductive wiper means mechanically coupled to said control member for movement therewith relative to said resistor member and including an elongate finger-like strip having a curved knuckle portion slidably engaged with said resistor member for movement along said member in response to said controlled movement of said control member, said knuckle portion of said strip having a transverse cross-sectional configuration elongated transversely of the finger and having rounded opposite side edge surfaces and a contact surface extending between said side surfaces in facing opposed relationship to said resistor member, the radius of curvature of said contact surface being substantially greater than that of said side surfaces.

2. The invention defined in claim 1 wherein said strip is of an elliptical transverse cross-sectional configuration.

3. The invention of claim 1 or claim 2, wherein the contact between said strip and said resistor member is theoretically a line contact transverse to said strip and said member.

4. The invention defined in claim 2 wherein said strips are subject to being tilted in a manner such that the transverse axis of an individual strip may be inclined from the flat surface of the resistor at an angle A and said contact surface is a convex surface having a radius of curvature R such that radii from opposite ends of said contact surface intersect each other at an included angle equal to approximately 2A.

5. For use in an operating system wherein a movable control member is adjustably movable over a selected range of controlled movement and is also subjected to uncontrolled movement such as might be induced by extraneous vibration, shock loading or the like; a variable electrical resistor adapted to be connected in an electrical circuit to electrically signal the position of said control member within its selected range of movement, said resistor including a fixedly located, flat, elongate electrical resistor member, electrically conductive wiper means mechanically coupled to said control member for movement therewith relative to said resistor member and including an elongate finger-like strip having a curved knuckle portion slidably engaged with said resistor member for movement along said member in response to said controlled movement of said control member, said knuckle portion of said strip having a transverse cross-sectional configuration elongated transversely of the finger and having rounded opposite side edges and a resistor contact portion extending between said side edges in facing opposed relationship to said resistor member.

6. In a throttle position sensor for electrically sensing the rotative position of a throttle shaft, an electrically non-conductive rotor fixedly mounted on said shaft for rotation therewith, a stationary electrically non-conductive housing enclosing said rotor, an elongate, flat surfaced electrical resistor fixedly mounted in said housing and extending along a circular arc concentric with the axis of rotation of said shaft, and electrically conductive wiper means fixedly mounted on said rotor and projecting from said rotor to slidably engage said resistor;

the improvement wherein said wiper means comprises a plurality of elongate, electrically conductive, strips each fixed at one end to said rotor and having a curved knuckle portion adjacent the free end of the strip remote from said rotor slidably engaging the flat surface of said resistor, said strips each having a transverse width substantially greater than its thickness and having rounded parallel side edges and a contact surface extending transversely between said side edges, said strips extending from said rotor in adjacent, parallel, side-by-side relationship to each other and being resiliently biased to engage said resistor along a line extending radially of said axis.

* * * * *